US006055681A

United States Patent [19]

Lyons

[11] Patent Number: 6,055,681

[45] Date of Patent: May 2, 2000

[54] URINAL ANTI-SPLASH-BACK APPARATUS AND ASSOCIATED METHODS

[76] Inventor: James P. Lyons, 11267 Scenic View, Orlando, Fla. 32821

[21] Appl. No.: 09/150,254

[22] Filed: Sep. 9, 1998

[51] Int. Cl.[7] ..... E03D 9/00

[52] U.S. Cl. ..... 4/300.3; 4/310

[58] Field of Search ..... 4/300.3, 309, 310, 4/661, 902

[56] References Cited

U.S. PATENT DOCUMENTS

| | | | |
|---|---|---|---|
| 2,525,531 | 10/1950 | Dorff | 4/581 |
| 4,574,403 | 3/1986 | Dintemann et al. | 4/309 |
| 4,866,793 | 9/1989 | Luedtke et al. | 4/300.3 |
| 5,398,347 | 3/1995 | Luedtke et al. | 4/300.3 X |
| 5,809,590 | 9/1998 | Williams et al. | 4/300.3 X |

*Primary Examiner*—Charles E. Phillips
*Attorney, Agent, or Firm*—Allen, Dyer, Doppelt, Milbrath & Gilchrist, P.A. Attorneys at Law

[57] ABSTRACT

A urinal anti-splash-back apparatus and associated methods are provided which preferably include a frame, a urine anti-splash-back filtering device mounted to the frame for filtering urine so that major portions of urine being deposited against an outer surface thereof are prevented from splashing back toward the urine depositor, and a urinal frame mount connected to the frame and positioned to be mounted to an inner back wall of a urinal for readily mounting the frame to the inner back wall of the urinal. The urine anti-splash-back filtering device preferably includes a urine filter material which absorbs urine and is preferably formed of a fibrous material, such as a fabric fibrous material. A method of reducing splash-back in a urinal is provided which preferably includes attaching a urine absorbing and filtering material to an inner back wall of a urinal.

32 Claims, 5 Drawing Sheets

4
35
20
10
30
35
30
21
35
30

URINAL ANTI-SPLASH-BACK APPARATUS AND ASSOCIATED METHODS

FIELD OF THE INVENTION

This invention is related to the lavatory attachment industry and, more particularly, to anti-splash-back filtering systems and associated methods within the lavatory attachment industry.

BACKGROUND OF THE INVENTION

Over the years, various devices have been developed for attachments to toilets to reduce splash-back from feces or urine when a person is using the toilet. The impact of feces or urine upon the surface of water residing in a toilet creates a splash which can lead to noise and spraying of water onto surrounding surfaces, including the person using the toilet. Examples of such a toilet anti-splash devices can be seen in U.S. Pat. No. 5,031,253 by Brendlinger titled "*Method Of Making A Sanitary Toilet Anti-Splash And Silencer Device And Article Produced Thereby,*" U.S. Pat. No. 4,866,793 by Luedtke et al. titled "*Toilet Anti-Splash Device,*" U.S. Pat. No. 3,212,104 by Stevens titled "*Anti-Noise And Splash Screen For A Toilet,*" and U.S. Pat. No. 2,931,047 by Stebbins titled "*Anti-Noise And Anti-Splash Attachment For A Toilet Bowl.*" These devices, however, focus only on aspects related to toilet bowls, provide screens or screening devices at strategic locations on the toilet bowl such as mounted to the hinge of the bowl cover or floating on the water in the bowl itself.

These prior known devices also fail to address the differences between a urinal and a toilet bowl. For example, a user of a urinal is often closer to the urinal inner back wall than the water within the urinal. The user of a toilet bowl, however, can be close to the water within the toilet bowl if sitting but not very close to water if standing. Accordingly, the splash-back from a urinal is usually from the inner back wall surface or other urinal filter surface positioned in the urinal. This splash-back can cause the spraying of urine to return to the user's legs, pants, and/or undergarments, as well as other surrounding regions. Because of the closeness of the urine projection, the splash-back problems may increased and the noise heard by others may slightly decrease.

Although filtering screens, such as shown in U.S. Pat. No. 2,813,631 by Odman titled "*Strainer Devices And Detachable Shaker Handles Therefor*" and German Published Patent Document (DE 26 34 550 A) titled "*Protection Screen Filter For Urinals—Has Flat Screen Base Fitted Into Basin And Is Readily Removed,*" have been known for years, these filtering screens do little to reduce the splash-back and noise problems with urinal usage. Because these filters are formed of metal or plastic and have only a simple mesh structure, when positioned in a urinal such screens can often increase the splash-back problem.

SUMMARY OF THE INVENTION

In view of the foregoing, the present invention advantageously provides an apparatus and methods for greatly reducing urine splash-back and noise when using a urinal. The present invention also advantageously provides a urinal anti-splash-back apparatus and methods which readily attach to and detach from an existing urinal in strategic locations so that splash-back and noise are greatly reduced and privacy for a user or urine depositor is increased, e.g., the user can stand closer to the urinal without fear of receiving splash-back on his body or clothing. The present invention additionally provides a urinal anti-splash-back apparatus and methods which provides an inexpensive replacement filter for readily disposing of used filter which are damaged or soiled such as from extensive use without the requirement of replacing the filter supporting structure and which provides self-cleaning aspects when mounted within a urinal. The present invention further provides anti-splash-back kits which can be readily ordered and installed by existing establishments without complicated installation requirements and which are readily adaptable to different size and shapes of urinal configurations.

More particularly, the present invention provides a urinal anti-splash-back apparatus having a frame, urine anti-splash-back filtering means mounted to the frame for filtering urine so that major portions of urine being deposited against an outer surface thereof are prevented from splashing back toward the urine depositor, and urinal frame mounting means connected to the frame and positioned to be mounted to an inner back wall of a urinal for readily mounting the frame to the inner back wall of the urinal. The urine anti-splash-back filtering means preferably includes a urine filter material which absorbs urine, and is preferably formed of a fibrous material, such as a fabric fibrous material.

Methods of reducing urine splash-back are also advantageously provided. A method of reducing splash-back in a urinal preferably includes attaching a urine absorbing and filtering material to an inner back wall of a urinal. Another method of reducing urine splash-back preferably includes mounting a urine absorbing and filtering material formed of a fibrous material, such as a fabric fibrous material, to a frame and mounting the frame to a lavatory fixture.

A urinal anti-splash-back kit is also provided according to the present invention so that an establishment can readily order and assembly the kit on-site. The kit preferably includes a frame having a plurality of mounting sockets connected thereto, at least one urine absorbing and filtering device, and a plurality of mounting legs for detachably connecting to the plurality of mounting sockets. The plurality of mounting legs preferably include at least two different predetermined lengths. After the urine absorbing and filtering device has been extensively used or damaged, the urine absorbing and filtering device can advantageously be readily detached from the frame, disposed of, and readily replaced with a new urine absorbing and filtering device.

By providing a frame and frame mounting structure which readily adapt for mounting to an inner back wall of a various urinal configurations, the apparatus can easily and inexpensively be attached to existing urinals. The fibrous, such as a fibrous fabric, filtering and urine absorbing material which is mounted to the frame can then be positioned for use as well as ready disposal. The fibrous material, such as a fibrous fabric material, can also have a special sanitation coating or dip applied thereto prior to installation to provide added cleanliness and health advantages. The fibrous material additionally provides a surface to which indicia, such as logos, designs, names, or the like, can readily be added to provide a user of an establishment with customized devices for urinals. The fibrous material can further advantageously be treated for use in detecting alcohol content of a person urinating and can change colors, for example, to indicate various levels of alcohol intake by the person urinating.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation if used indicate similar elements in alternative embodiments.

Figure 1:
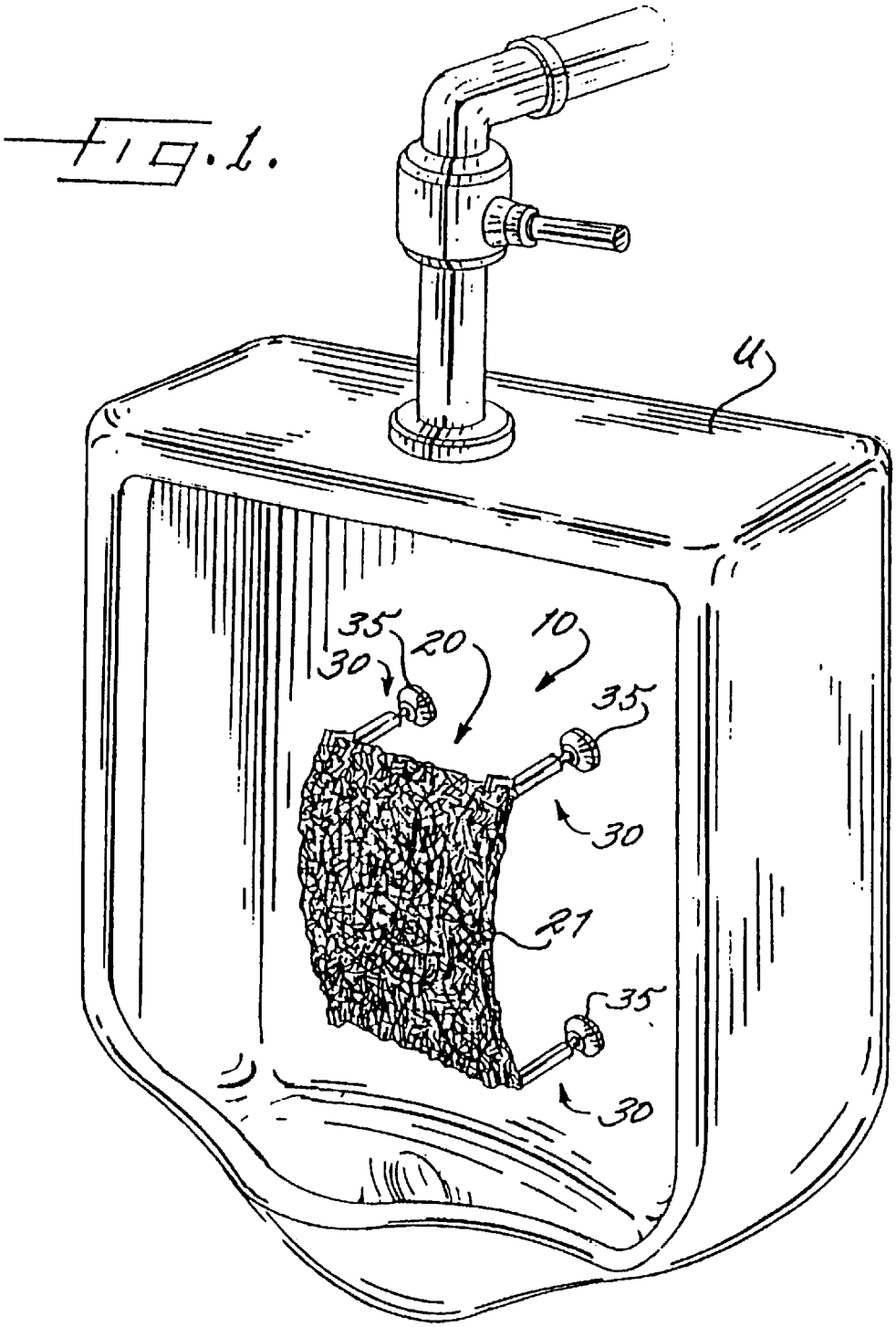
FIG. 1 is a perspective view of a combination urinal and anti-splash-back apparatus positioned therein according to the present invention.
Figure 2:
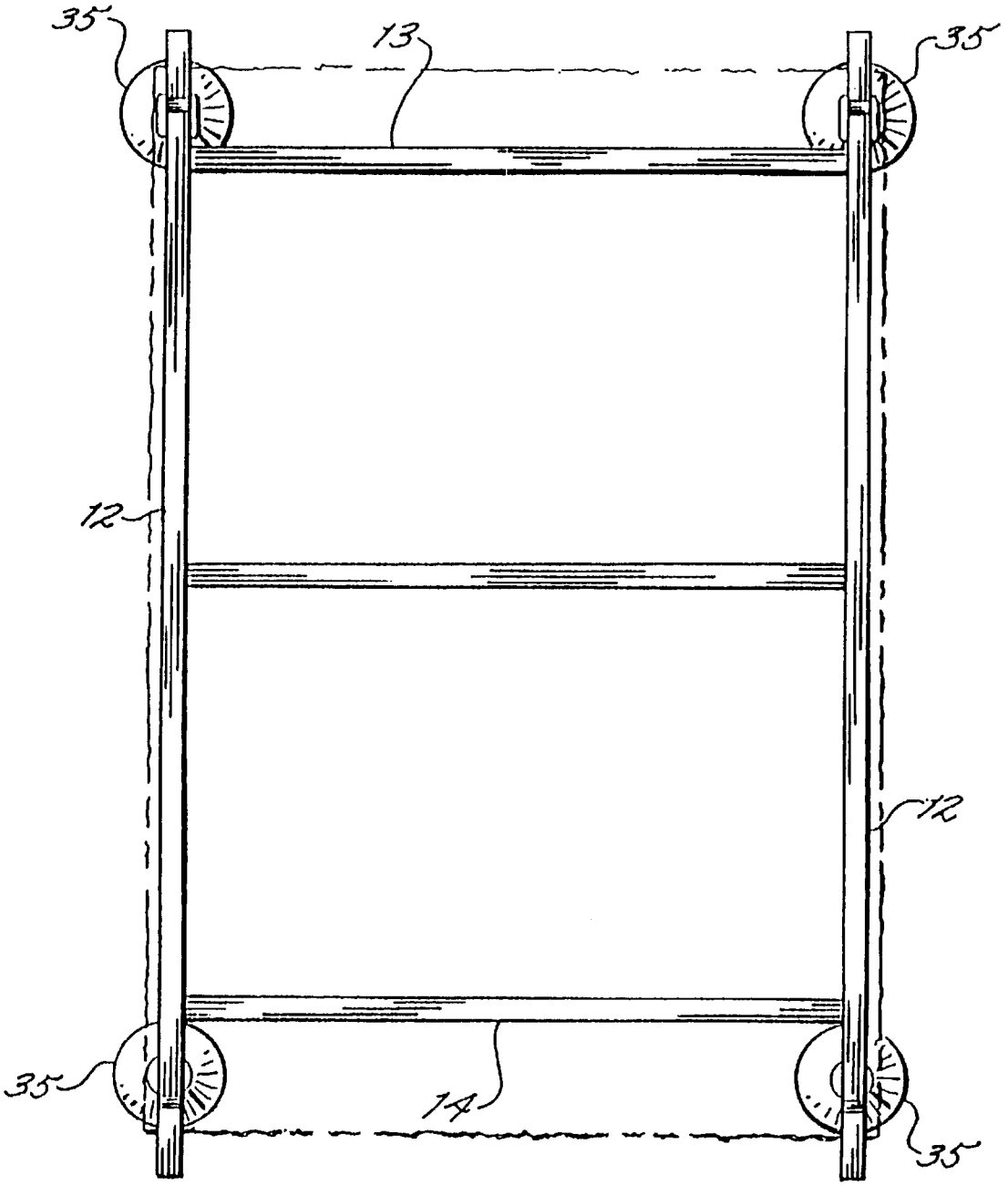
FIG. 2 is a front elevational view of a urinal anti-splash-back apparatus according to the present invention and having a fibrous, such as a fabric fibrous, urine filter shown in phantom lines.
Figures 3, 4A, 4B:
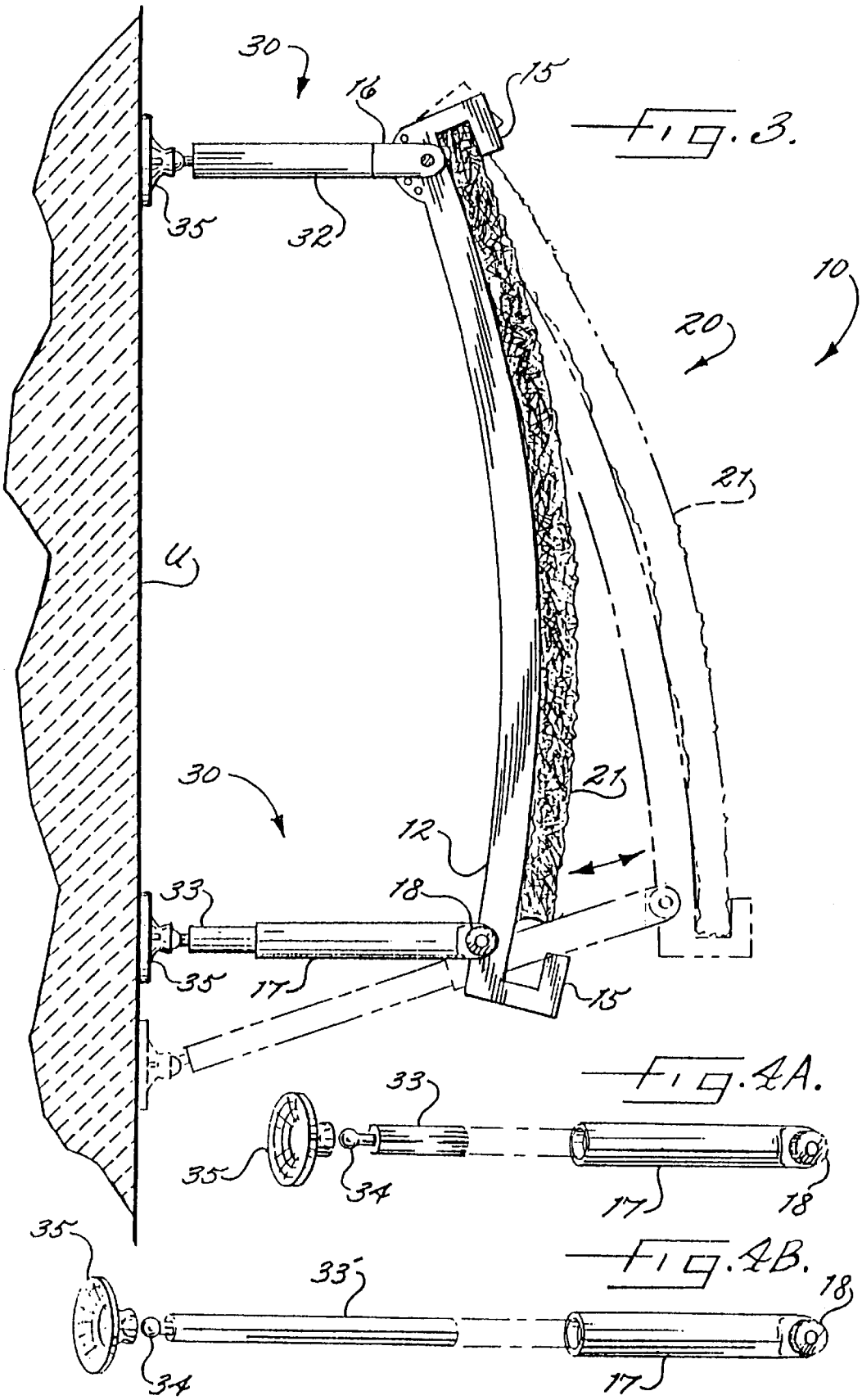
FIG. 3 is a side elevational view of a urinal anti-splash-back apparatus according to the present invention and having an alternative lower leg length and position of the apparatus shown in phantom lines.
FIGS. 4A–4B are perspective views of lower leg assemblies of a urinal anti-splash-back apparatus according to the present invention.

FIG. 1 illustrates a combination of a urinal and a urinal anti-splash-back apparatus 10 positioned within the urinal U according to the present invention. The urinal U can have various conventional urinal configurations, including port-o-let urinal-type configurations, as understood by those skilled in the art and should not be limited to the example illustrated. As illustrated in FIGS. 1–3, the urinal anti-splash-back apparatus 10 preferably has a frame 12, urine anti-splash-back filtering means, e.g., preferably provided by a urine anti-splash-back device 20, mounted to the frame 12 for filtering urine so that major portions of urine being deposited against an outer surface thereof are prevented from splashing back toward a urine depositor or person using the urinal U, and urinal frame mounting means 30 connected to the frame 12 and positioned to be mounted to an inner back wall of a urinal U for readily mounting the frame 12 to the inner back wall of the urinal U.

Figure 5:
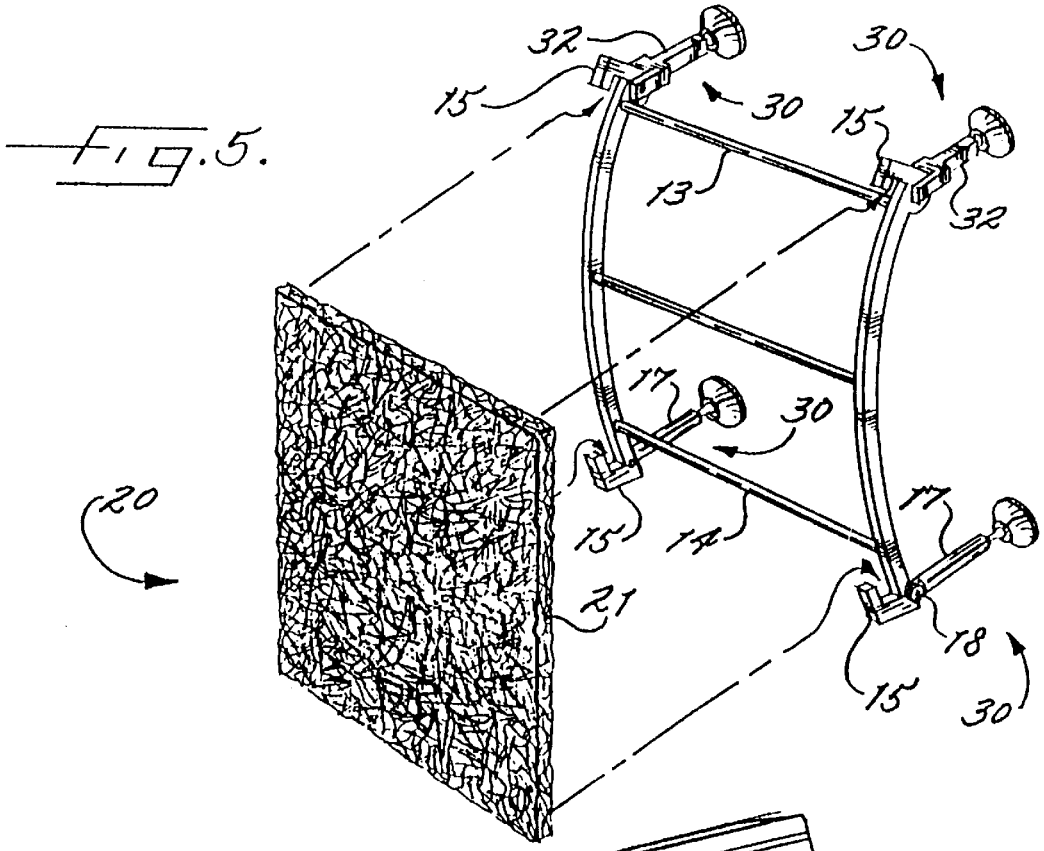
FIG. 5 is an exploded perspective view of a urinal anti-splash-back apparatus according to the present invention.
Figure 6:
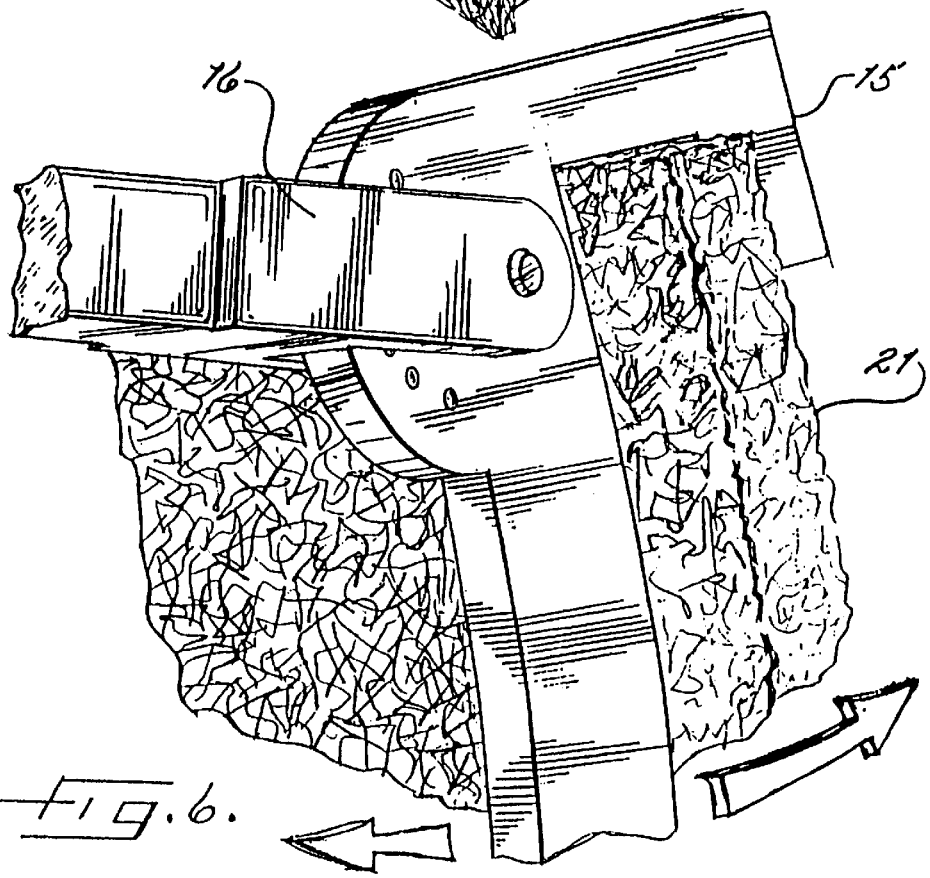
FIG. 6 is an enlarged fragmentary view of a portion of a urinal anti-splash-back apparatus and showing the pivotal movement of an upper leg assembly according to the present invention.

As perhaps best shown in FIGS. 3 and 5–6, the urine anti-splash-back absorbing and filtering means 20 preferably includes a sheet 21 of a urine filter material which absorbs urine, and is preferably formed of a fibrous material, such as a fabric fibrous material. The fibrous material, such as a fibrous fabric material, is preferably formed of a non-woven fibrous material such as manufactured or supplied by Cumulus Fibers, Inc., of Charlotte, N.C., as Style nos. 45B081 or 60PRN0100. This fibrous material can also advantageously have a plurality of layers of different density so that the less dense material is closer to the person urinating and the more dense material is closer to the inner back wall of the urinal. The fibrous material is preferably coated or dipped for treatment with an anti-bacterial solution as used in the toilet and urinal industries on bowl blocks and urinal screens and as understood by those skilled in the art. The urine absorbing and filtering material can also be treated with a fragrance or odor enhancing fluid and can be color coordinated with a lavatory, bathroom, customer theme, or other establishment. The urine absorbing and filtering material preferably is cut in a sheet or other configuration which matches or corresponds to the shape of the frame so that the frame 12 readily supports the sheet when mounted thereto and advantageously both absorbs urine and filters urine so that urine does not splash back toward a urinal user. The fibrous material additionally provides a surface to which indicia, such as logos, designs, names, or the like, can readily be added to provide a user of an establishment with customized devices for urinals. The fibrous material can further advantageously be treated for use in detecting alcohol content of a person urinating and can change colors, for example, to indicate various levels of alcohol intake by the person urinating. Such a treatment can be used for detection while the person is actively urinating by having regions which either temporarily or permanently change color so that the user will have some indication of intoxication level, e.g., to prevent or encourage driving of a vehicle thereafter.

As shown in FIGS. 2–3 and 5–6, the frame 12 preferably has a generally rectangular shape and has at least two pairs 13, 14 of generally parallel cross members connected at four respective comers forming the overall larger rectangular shape as illustrated. Additional cross members 13 can also be included for further structural support, e. g., in a medial portion thereof. The frame 12, however, can also be circular, oval, trapezoidal, or other shapes as well according to the present invention. The frame 12 also preferably includes at least a pair of retainers 15 for retaining the urine anti-splash-back absorbing and filtering means when mounted to the frame. The retainers 15 are preferably connected to and formed integrally with the frame 12 and extend outwardly from the cross members 13, 14. The frame 12, more particularly, preferably has four retainers 15 each of which has a generally hook shape, e.g. opposing pairs of hook retainers 15 as illustrated, so that the sheet of urine absorbing and filtering material can readily be positioned within the hook region of the retainers 15. The frame 12 also preferably includes a plurality of mounting sockets 16, 17 connected to the cross members 13, 14 on an opposing surface from the retainers 15. The plurality of sockets 16, 17 preferably each have a generally tubular construction as illustrated and include a pair of upper mounting sockets 16 and a pair of lower mounting sockets 17.

As shown in FIG. 6, the frame 12 preferably also includes socket pivot positioning means connected to the plurality of upper mounting sockets 16 and to the frame 12 for pivotally positioning the plurality of upper mounting sockets 16 in one of a plurality of pivot positions so that the frame 12 can readily be adjusted to a desired mounting position. The socket pivot positioning means preferably includes an enlarged surface region having a plurality of detents formed therein which interfacingly engage a bulbous member or prong extending outwardly from a portion of the socket 16. Such detents and interfacing bulbous members are well understood by those skilled in the art.

Figure 8:
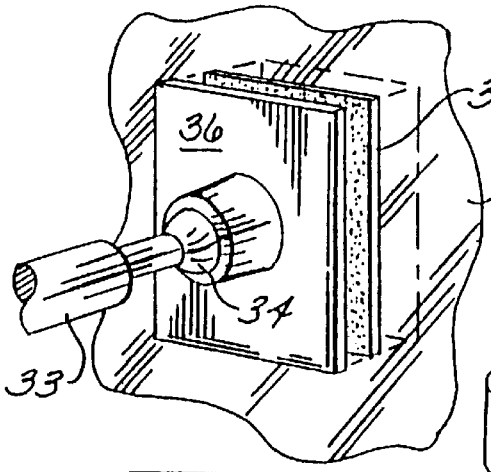
FIG. 8 is a perspective view of an alternative embodiment of adhering legs of a urinal anti-splash-back apparatus to a wall of a urinal according to the present invention.

The urinal frame mounting means 30 preferably includes a plurality of leg members 32, 33 each interfacing with a corresponding one of the plurality of mounting sockets 16, 17, which secure to the frame by a snap-fit fastener 18 or other fixedly securable or adjustable fastener. Each of the plurality of leg members 32, 33 of the urinal frame mounting means can include a suction member for interfacing with and adhesively adhering to an inner back wall of the urinal U such as illustrated in FIGS. 1–3 or can include double-sided adhesive material or tape 37, as understood by those skilled in the art, mounted to a plate member 36 as illustrated in FIG. 8. The double-sided tape, for example, advantageously can provide a more permanence to the mounting of the apparatus to a wall of a urinal. The legs preferably each have a suction cup or suction member 35 connected to an end thereof as illustrated so that the suction member 35 interfaces with the inner back wall of the urinal U and adheres when pressure is applied to the suction member 35. The plurality of leg members 32, 33 preferably also include a pair of upper leg members 32 and a pair of lower leg members 33 which respectively correspond to the pair of upper mounting sockets 16 and the pair of lower mounting sockets 17. By upper and lower as used herein, it is meant that a urinal U is generally positioned along a vertical wall or mounting surface and may include portions mounted to or positioned on a floor. Accordingly, upper would be a generally higher elevation on the vertical wall than the lower such as illustrated in FIGS. 1–3 and 7.

As perhaps best illustrated in FIGS. 3 and 4A–4B, the plurality of lower leg members 33 of the urinal frame mounting means 30 can advantageously include a first plurality of lower leg members 33 each having a first predetermined length, and the urinal frame mounting means 30 can further include a second plurality of lower leg members 33' each having a second predetermined length. In other words, the legs 33, 33' extend the frame 12 outwardly from the inner back wall of the urinal U a desired distance so that the frame 12 has an angular orientation, as shown in FIG. 3, for different types of urinals and for different urine collecting positions.

Figure 7:
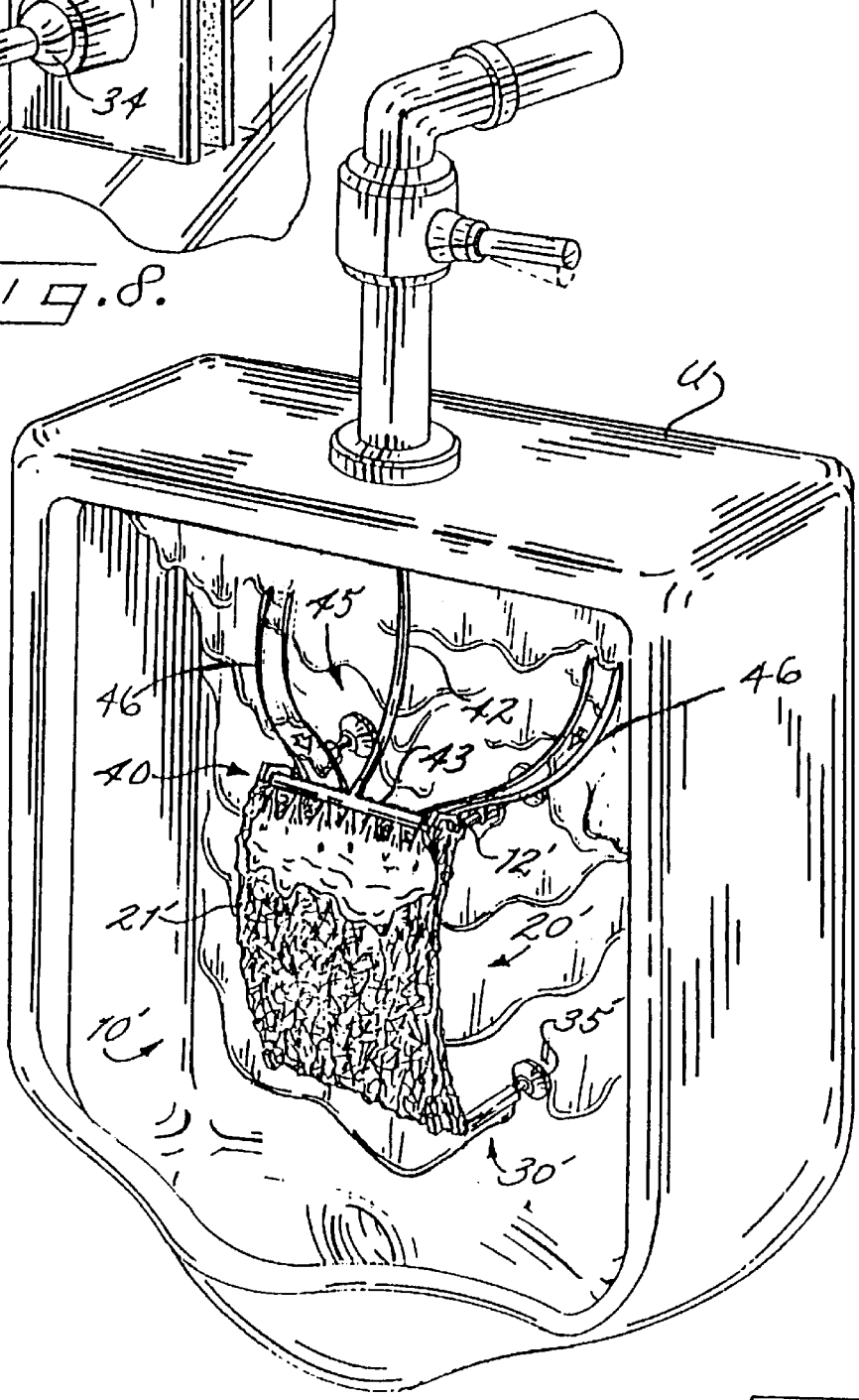
FIG. 7 is a perspective view of an alternative embodiment of a urinal anti-splash-back apparatus having a fibrous, such as a fabric fibrous, filter cleansing device associated therewith according to the present invention.

As shown in FIG. 7, an alternative embodiment of a urinal anti-splash-back apparatus 10' preferably includes rinsing means 40 positioned adjacent the urinal anti-splash-back absorbing and filtering means 20' for periodically rinsing the urinal anti-splash-back absorbing and filtering means 20'. The rinsing means 40 preferably includes a rinsing tube 45 positioned to collect liquid from an upper portion of the urinal U and release liquid onto the urinal anti-splash-back absorbing and filtering means 20' as illustrated. The rinsing tube 45 preferably has a suction member, a tie, or other attaching means (not shown) connected thereto for adhering the rinsing tube in a position to collect liquid, e.g., water. The rinsing tube 45 has a first portion 42 positioned in a generally vertical orientation and a second portion 43 positioned in a generally horizontal orientation. The second portion is preferably connected to the frame 12', has one or more openings formed along a wall thereof for allowing a liquid to flow therethrough, and can interfacingly engage the sheet of the urine absorbing and filtering material 21'. Either alternatively or in combination, the rinsing means can advantageously include one or more water ramps 46 which can be mounted to the legs of the apparatus as illustrated, such as by clips, fasteners, or ties as understood by those skilled in the art. The water ramps 46 can be of various widths and lengths or shapes, but preferably direct or channel water from upper portions of the urinal to the rear of the filtering material 21' by providing a sloping and smooth upper surface thereof onto which the water can readily flow and preferably has outer ridges or lips which define peripheries of the upper surface for guiding the water therealong. Other structures for the rinsing means 40, such as a manifold tubular structure and/or a separate fluid dispenser as understood by those skilled in the art, can also be alternatively used or used in combination according to the present invention.

As illustrated in FIGS. 1–8, methods of reducing urine splash-back are also advantageously provided. A method of reducing splash-back in a urinal preferably includes attaching a urine absorbing and filtering material 21 to an inner back wall of a urinal U. The attaching step preferably includes mounting a urine absorbing and filtering material 21 to a frame 12 and adhesively adhering the frame 12 to the inner back wall of the urinal U. The method can also advantageously include positioning lower portions of the frame 12 outwardly from the inner back wall a greater distance than upper portions of the frame 12 so that lower portions of the urine absorbing material 21 are positioned closer to a urine depositor than upper portions of the urine absorbing and filtering material 21 and periodically rinsing the urine absorbing and filtering material 21 with liquid received from portions of the urinal positioned at a higher elevation than the urine absorbing material 21 to thereby clean the urine absorbing and filtering material 21.

Another method of reducing urine splash-back preferably includes mounting a urine absorbing and filtering material 21 formed of a fibrous material, such as a fabric fibrous material, to a frame 12 and mounting the frame 12 to a lavatory fixture. The method can also advantageously include positioning lower portions of the frame 12 outwardly from an inner wall of the lavatory fixture a greater distance than upper portions of the frame 12 so that lower portions of the urine absorbing and filtering material 21 are positioned closer to a urine depositor than upper portions of the urine absorbing and filtering material 21 and periodically rinsing the urine absorbing and filtering material 21 with liquid to thereby clean the urine absorbing and filtering material 21.

As perhaps best shown in FIGS. 3–5, a urinal anti-splash-back kit is also provided according to the present invention so that an establishment can readily order and assemble the kit on-site. The kit preferably includes a frame 12 having a plurality of mounting sockets 16, 17 connected thereto, at least one urine absorbing and filtering device 20, and a plurality of mounting legs 32, 33, 33' for detachably connecting to the plurality of mounting sockets 16, 17. The plurality of mounting legs 33, 33' preferably include at least two different predetermined lengths. After the urine absorbing and filtering device 20 has been extensively used or damaged, the urine absorbing and filtering device 20 can advantageously be readily detached from the frame 12, disposed of, and readily replaced with a new urine absorbing and filtering device 20.

By providing a frame 12 and frame mounting structure 30 which readily adapt for mounting to an inner back wall of a urinal U, the apparatus 10 can easily and inexpensively be attached to existing urinals. The fibrous, such as a fabric fibrous, filtering and urine absorbing material 21 which is mounted to the frame 12 can then be positioned for use as well as ready disposal. The fibrous, such as a fabric fibrous, material can also have a special sanitation coating or dip applied thereto prior to installation to provide added cleanliness and health advantages. The fibrous, such as a fabric fibrous, material additionally provides a surface to which indicia, such as logos, designs, names, or the like, can readily be added to provide a user of an establishment with customized devices for urinals.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A urinal anti-splash-back apparatus comprising:

a urinal including an inner back wall;

a frame;

urine anti-splash-back absorbing and filtering means mounted to said frame for absorbing and filtering urine so that major portions of urine being deposited against an outer surface thereof are prevented from splashing back toward a urine depositor; and urinal frame mounting means connected to said frame and mounted to the inner back wall of said urinal for readily mounting said frame to the inner back wall of said urinal.

2. An apparatus as defined in claim 1, wherein said urine anti-splash-back absorbing and filtering means includes a urine filter material formed of a fibrous material.

3. An apparatus as defined in claim 1, wherein said frame includes at least a pair of retainers for retaining said urine anti-splash-back absorbing and filtering means when mounted to said frame.

4. An apparatus as defined in claim 1, wherein said frame includes a plurality of mounting sockets, and wherein said urinal frame mounting means includes a plurality of leg members each interfacing with a corresponding one of said plurality of mounting sockets.

5. An apparatus as defined in claim 4, wherein each of said plurality of leg members of said urinal frame mounting means includes a member for interfacing with and adhesively adhering to an inner back wall of said urinal.

6. An apparatus as defined in claim 5, wherein said plurality of leg members include a pair of upper leg members and a pair of lower leg members, and wherein said plurality of mounting sockets include a pair of upper mounting sockets and a pair of lower mounting sockets.

7. An apparatus as defined in claim 6, wherein said plurality of lower leg members of said urinal frame mounting means comprises a first plurality of lower leg members each having a first predetermined length, and wherein said urinal frame mounting means further includes a second plurality of lower leg members each having a second predetermined length.

8. An apparatus as defined in claim 6, wherein said frame further includes socket pivot positioning means connected to said plurality of upper mounting sockets and to said frame for pivotally positioning said plurality of upper mounting sockets to in one of a plurality of pivot positions so that said frame can readily be adjusted to a desired mounting position.

9. An apparatus as defined in claim 1, further comprising rinsing means positioned adjacent said urinal anti-splash-back absorbing and filtering means for rinsing said urinal anti-splash-back absorbing and filtering means.

10. An apparatus as defined in claim 9, wherein said rinsing means includes a rinsing tube positioned to collect liquid from an upper portion of said urinal and release liquid onto said urinal anti-splash-back absorbing and filtering means.

11. A urinal anti-splash-back apparatus comprising:

urine anti-splash-back absorbing and filtering means for absorbing and filtering urine so that major portions of urine being deposited against an outer surface thereof are prevented from splashing back toward a urine depositor; and urinal mounting means associated with said urine anti-splash-back absorbing and filtering means and positioned to be mounted to an inner back wall of a urinal for readily mounting said urine anti-splash-back absorbing and filtering means to the inner back wall of the urinal.

12. An apparatus as defined in claim 11, further comprising a frame, and wherein said urine anti-splash-back absorbing and filtering means is mounted to said frame and includes a urine filter material which absorbs urine.

13. An apparatus as defined in claim 12, wherein said urine filter material is formed of a fabric fibrous material.

14. An apparatus as defined in claim 13, wherein said frame includes at least a pair of retainers for retaining said urine anti-splash-back absorbing and filtering means when mounted to said frame.

15. An apparatus as defined in claim 14, wherein said frame includes a plurality of mounting sockets, and wherein said urinal frame mounting means includes a plurality of leg members each interfacing with a corresponding one of said plurality of mounting sockets.

16. An apparatus as defined in claim 15, wherein each of said plurality of leg members of said urinal frame mounting means includes a member for interfacing with and adhesively adhering to an inner back wall of said urinal.

17. An apparatus as defined in claim 16, wherein said plurality of leg members include a pair of upper leg members and a pair of lower leg members, and wherein said plurality of mounting sockets include a pair of upper mounting sockets and a pair of lower mounting sockets.

18. An apparatus as defined in claim 17, wherein said plurality of lower leg members of said urinal frame mounting means comprises a first plurality of lower leg members each having a first predetermined length, and wherein said urinal frame mounting means further includes a second plurality of lower leg members each having a second predetermined length.

19. An apparatus as defined in claim 18, wherein said frame further includes socket pivot positioning means connected to said plurality of upper mounting sockets and to said frame for pivotally positioning said plurality of upper mounting sockets to in one of a plurality of pivot positions so that said frame can readily be adjusted to a desired mounting position.

20. An apparatus as defined in claim 19, further comprising rinsing means positioned adjacent said urinal anti-splash-back absorbing and filtering means for rinsing said urinal anti-splash-back absorbing and filtering means.

21. An apparatus as defined in claim 20, wherein said rinsing means includes a rinsing tube positioned to collect liquid from an upper portion of said urinal and release liquid onto said urinal anti-splash-back absorbing and filtering means.

22. An anti-splash-back apparatus comprising:

a frame including a plurality of mounting sockets and at least a pair of retainers;

anti-splash-back absorbing and filtering means mounted to said frame for absorbing and filtering fluid so that major portions of fluid being deposited against an outer surface thereof are prevented from splashing back toward a fluid depositor, said anti-splash-back absorbing and filtering means including a fluid absorbing material positioned to be retained by the at least a pair of retainers of said frame for absorbing fluid deposited against the outer face thereof, said fluid absorbing material being formed of a fabric fibrous material; and frame mounting means connected to said frame and positioned to be mounted to a surface for readily mounting said frame to the surface, said frame mounting means including a plurality of leg members each interfacing with a corresponding one of said plurality of mounting sockets of said frame.

23. An apparatus as defined in claim 22, wherein each of said plurality of leg members of said frame mounting means includes a member for interfacing with and adhesively adhering to the surface.

24. An apparatus as defined in claim 22, wherein said plurality of leg members include a pair of upper leg members and a pair of lower leg members, and wherein said plurality of mounting sockets include a pair of upper mounting sockets and a pair of lower mounting sockets.

25. An apparatus as defined in claim 23, wherein said plurality of lower leg members of said frame mounting means comprises a first plurality of lower leg members each having a first predetermined length, and wherein said urinal frame mounting means further includes a second plurality of lower leg members each having a second predetermined length.

26. An apparatus as defined in claim 24, wherein said frame further includes socket pivot positioning means connected to said plurality of upper mounting sockets and to said frame for pivotally positioning said plurality of upper mounting sockets to in one of a plurality of pivot positions so that said frame can readily be adjusted to a desired mounting position.

27. An apparatus as defined in claim 22, further comprising rinsing means positioned adjacent said anti-splash-back absorbing and filtering means for rinsing said anti-splash-back absorbing and filtering means.

28. An apparatus as defined in claim 27, wherein said rinsing means includes a rinsing tube positioned to collect liquid from a liquid source and release liquid onto said anti-splash-back absorbing and filtering means.

29. A method of reducing urine splash-back, the method comprising mounting a urine absorbing and filtering material formed of a fibrous material to a frame, mounting the frame to a lavatory fixture, and positioning the lower portions of the frame outwardly from an inner wall of the lavatory fixture a greater distance than the upper portions of the frame so that lower portions of the urine absorbing material are positioned closer to a urine depositor than upper portions of the urine absorbing material.

30. A method as defined in claim 29, further comprising periodically rinsing the urine absorbing and filtering material with liquid to thereby clean the urine absorbing material.

31. An anti-splash-back apparatus comprising:

a frame;

anti-splash-back absorbing and filtering means mounted to said frame for absorbing and filtering fluid so that major portions of fluid being deposited against an outer surface thereof are prevented from splashing back toward a fluid depositor, said anti-splash-back absorbing and filtering means including a fluid absorbing material for absorbing fluid deposited against the outer face thereof; and frame mounting means connected to said frame and positioned to be mounted to a surface for readily mounting said frame to the surface; and rinsing means positioned adjacent to said anti-splash-back absorbing and filtering means for rinsing said anti-splash-back absorbing and filtering means, said rinsing means includes a rinsing tube positioned to collect liquid from a liquid source and release liquid onto said anti-splash-back absorbing and filtering means.

32. A urinal anti-splash-back kit comprising:

a frame having a plurality of mounting sockets connected thereto;

at least one urine absorbing and filtering device; and a plurality of mounting legs for detachably connecting to the plurality of mounting sockets, the plurality of mounting legs including at least two different predetermined lengths.

* * * * *